United States Patent [19]

Berrill et al.

[11] 4,338,695

[45] Jul. 13, 1982

[54] SHOE UPPER CONFORMING MACHINE

[75] Inventors: William H. Berrill; George H. Bosworth, both of Leicester, England

[73] Assignee: USM Corporation, Farmington, Conn.

[21] Appl. No.: 135,978

[22] Filed: May 31, 1980

[30] Foreign Application Priority Data

Apr. 28, 1979 [GB] United Kingdom ..... 7914851

[51] Int. Cl.[3] ..... A43D 21/00; A43D 23/00

[52] U.S. Cl. ..... 12/10.1; 12/12; 12/145

[58] Field of Search ..... 12/10.1, 10.5, 12, 12.5, 12/145

[56] References Cited

U.S. PATENT DOCUMENTS

| | | | |
|---|---|---|---|
| 3,105,983 | 10/1962 | Deschens et al. | 12/12 |
| 3,178,742 | 4/1965 | Vollhardt et al. | 12/12 |
| 3,831,216 | 8/1974 | Vornberger | 12/145 |
| 3,868,737 | 3/1975 | Fichtner et al. | 12/12 |

*Primary Examiner*—Patrick D. Lawson

*Attorney, Agent, or Firm*—Donald N. Halgren

[57] ABSTRACT

A shoe side or combined heel seat and side lasting machine has two cement applying nozzles movable from an initial position, adjacent one another, outwardly to a first position, determined by abutments associated one with each nozzle, which abutments guide the nozzles in a straight line in the shoe bottom waist region. In the combined machine version, such outward movement causes a V-shaped pattern of adhesive to be applied in the shoe bottom heel seat region. Selector means is also provided for causing, according to whether the shoe is a left or right, the abutment associated with the nozzle tracking along the inside edge of the shoe bottom, to move from its first to a second position when the nozzle reaches the shoe bottom joint region, while the other nozzle continues in a straight line, thus to facilitate adhesive application to marginal portions of the shoe bottom up to the ball region.

16 Claims, 3 Drawing Figures

SHOE UPPER CONFORMING MACHINE

BACKGROUND OF THE INVENTION

1. Field of the Invention

This invention is concerned with shoe machines, and more especially with shoe machines for use in the lasting of side portions of shoe uppers, or for use in the combined lasting of side and heel end portions of shoe uppers.

2. Prior Art

Shoe machines for use in the lasting of side portions of shoe uppers are well known and generally comprise a support for a shoe last on which an upper, the side portions of which are to be lasted, and an insole are positioned, and has two side lasting assemblies arranged so as to act on opposite side portions of the upper placed on the last supported by said support. The machines also include cement applying means and means for effecting relative movement between the cement applying means and the last support in a direction extending lengthwise of the bottom of a shoe supported on said support wherein the cement can be progressively applied prior to the operation of the side lasting assemblies, between marginal portions of the insole and shoe upper in the region thereof to be lasted. In the prior art shoe lasting machines, cement applying means may comprise two nozzles arranged to apply the cement along opposite marginal portions simultaneously.

The nozzles are guided in the prior art shoe lasting machines, so that the applied cement lies uniformly spaced from the marginal edge of the insole or the lasting margin, as the case may be. Those machines may have nozzles which are provided with feelers that are engaged over the marginal edge of the insole and are urged inwardly, so as to follow the insole edge, or the upstanding lasting margin for the purpose of guiding those nozzles. Alternatively, templates have been provided, the configuration of which is determined by the shape of the insole, and which are engaged by a follower associated with the nozzles.

In these prior art cases, however, problems may arise, wherein the insole may be too flimsy to serve as a guide member, while the upstanding lasting margin may not be positioned sufficiently accurately on the last to serve as a guide for the nozzles. Furthermore, the use of templates requires a batch of templates for the styles to be operated upon, and thus has the disadvantage of lack of universality, such as is experienced when using the insole edge or upstanding lasting margin for the purpose of guiding the nozzles.

It is the object of the present invention to provide an improved shoe machine having cement applying means which applies adhesive between marginal portions of the insole and shoe upper in the region thereof to be lasted, without relying on those components of the shoe to be lasted for guiding the nozzles, and without the need for a large number of templates or the like to accommodate the lasting of different styles of shoes.

BRIEF SUMMARY OF THE INVENTION

The present invention thus provides a shoe machine for use in the lasting of side portions of shoe uppers comprising a support for a shoe last on which an upper, the side portions of which are to be lasted and an insole positioned, with two side lasting assemblies arranged so as to act on opposite side portions of an upper placed on a last supported by said support. The machine also has cement applying means and means for effecting relative movement between said cement applying means and the last support in a direction extending lengthwise of the bottom of a shoe supported on said support, whereby cement can be progressively applied prior to the operation of the side lasting assemblies, between marginal portions of the insole and shoe upper in the region thereof to be lasted. The cement applying means comprises two nozzles which are arranged to apply the cement along opposite marginal portions simultaneously wherein at least one of the nozzles is movable transversely of the shoe bottom under the control of a guide mechanism associated therewith from a first to a second predetermined position, during the relative movement between the cement applying means and the last support. The machine also having means for actuating said guide mechanism to enable such transverse movement to take place at a selected stage in said relative movement.

In the waist region of the shoe bottom, that is, between the heel breast line to the region of the end of the shank, adhesive can be applied in a straight line path. Beyond the waist region, furthermore, at the "outside" of the insole, which is not significantly curved outwardly, the straight line path can be continued up to the ball region of the shoe bottom. At the "inside," on the other hand, where the insole edge curves outwardly sharply, the straight line path cannot be continued to achieve marginal cementing. In order to control the cementing in the machine of the present invention, when the nozzle which tracks along the "inside" of the insole is in its first predetermined position, it follows a straight line path, but movement of the nozzle to its second predetermined position causes it to diverge outwardly from that straight line path in order to accommodate the curvature of the marginal portion of the insole.

While the one nozzle is thus movable transversely of the shoe bottom, the other is maintained in a fixed position transversely of the shoe bottom during relative movement between the cement applying means and the last support as aforesaid. Thus, said other nozzle continues its straight line path, along the "outside" of the insole, up to the ball region of the shoe bottom. If the machine of the present invention is adapted for use in the lasting of side portions of uppers of merely left shoes or of merely right shoes, that is with no provision for accepting either, the nozzle may be fixed in a position to effect cementing along its straight line path. On the other hand, where the machine is arranged to operate on either left or right shoes, each nozzle is preferably movable transversely of the shoe bottom under the control of an associated guide mechanism from a first to a second predetermined position during relative movement between the cement applying means and the last support as aforesaid. In a cycle of operation of the machine, only one of the nozzles is moved, a selector means being provided for determining which of the two guide mechanisms is actuated in the cycle to enable transverse movement of its associated nozzle to take place at the selected stage in its relative movement. For example, the last support may comprise a toe rest which is capable of swinging between two positions according to whether the shoe to be operated upon is a left or a right shoe, and the selector means may be operated by the toe rest support in an appropriate manner.

The nozzle guide mechanism associated with one nozzle conveniently comprises an abutment engageable by a portion of said nozzle, e.g. a pin mounted on the nozzle body, the abutment having a first and a second position, corresponding to the first and second predetermined positions of the nozzle, the mechanism further comprising means for moving the abutment between those positions to permit movement of the nozzle between its predetermined positions. The abutment is mounted in a support which is movable by the abutment moving means comprising a piston-and-cylinder arrangement. A second abutment is provided for limiting such movement of the support, thus determining the second position of the first-mentioned abutment. The first-mentioned abutment may be adjustably mounted on the support and also the second abutment may be adjustable to vary the first and second positions of the first-mentioned abutment respectively. The first and second positions of said first-mentioned abutment may be determined according to the width of the shoe bottom in the waist and ball regions thereof respectively.

The nozzle is movable by a piston-and-cylinder arrangement to bring it into engagement with the first-mentioned abutment. The piston-and-cylinder arrangement of the abutment moving means can hold the abutment in its first position when the stop is urged thereagainst by the piston-and-cylinder arrangement of the nozzle moving means. Although the piston-and-cylinder arrangement of the abutment moving means may be single-acting, wherein application of fluid pressure to one side there of is effective to hold the abutment in its first position and application of fluid under pressure to the other side thereof may cause the abutment to be moved to its second position, means may also be provided for variably regulating the pressure of the fluid supplied to the other side of the piston-and-cylinder arrangement of the abutment moving means to regulate the speed of outward movement of the nozzle when the abutment moves from its first to its second position. A given speed of relative movement between the cement applying means and the last support may predicate the angle at which the path of the nozzle diverges from the straight line path.

The nozzles are movable, in their initial position so they can engage the insole centrally thereof, and be thereafter moved outwardly into their respective positions for straight line cementing. This movement is useful in the lasting of heel seat and side portions of a shoe upper, the outward movement from the initial position of the nozzles being effective to deposit a V-shaped cement pattern at the heel seat region of the shoe bottom.

The invention also provides a shoe machine for use in the lasting of heel seat and side portions of a shoe upper, the machine comprising a support for a shoe last on which an upper, the side portions of which are to be lasted and an insole are positioned, the machine including heel band, heel seat wiper means and two side lasting assemblies arranged to act respectively on the heel seat and opposite side portions of an upper placed on a last supported by the last support. Cement applying means are movable lengthwise of the bottom of a shoe supported on the last support from a start position at the heel end of said shoe toewardly, whereby cement can be progressively applied, prior to the wiping operation, between marginal portions of the insole and shoe upper in the region thereof to be lasted. The cement applying means comprises two nozzles arranged to apply cement along opposite marginal portions simultaneously, and two nozzle guide mechanisms, one associated with each nozzle, wherein each nozzle is movable transversely of the shoe bottom between an initial position in which the two nozzles are adjacent one another, and a position determined by the guide mechanism associated with said nozzle. One of the nozzles may be movable transversely of the shoe bottom under the control of its associated guide mechanism from a first predetermined position, to which it is moved from said initial position to a second predetermined position, the movement of said nozzle from its first to its second predetermined position taking place during relative movement between the cement applying means and the last support. Actuating means are provided for actuating said guide mechanism to enable such transverse movement to take place at a selected stage in said relative movement.

The nozzle guidance mechanisms may also comprise template means by which the nozzles are guided from their initial position during relative movement between the cement applying means and last support.

BRIEF DESCRIPTION OF THE DRAWINGS

The objects and advantages of the invention will become more apparent when viewed in conjunction with the following drawings, in which.

DESCRIPTION OF THE PREFERRED EMBODIMENTS

Figure 1:
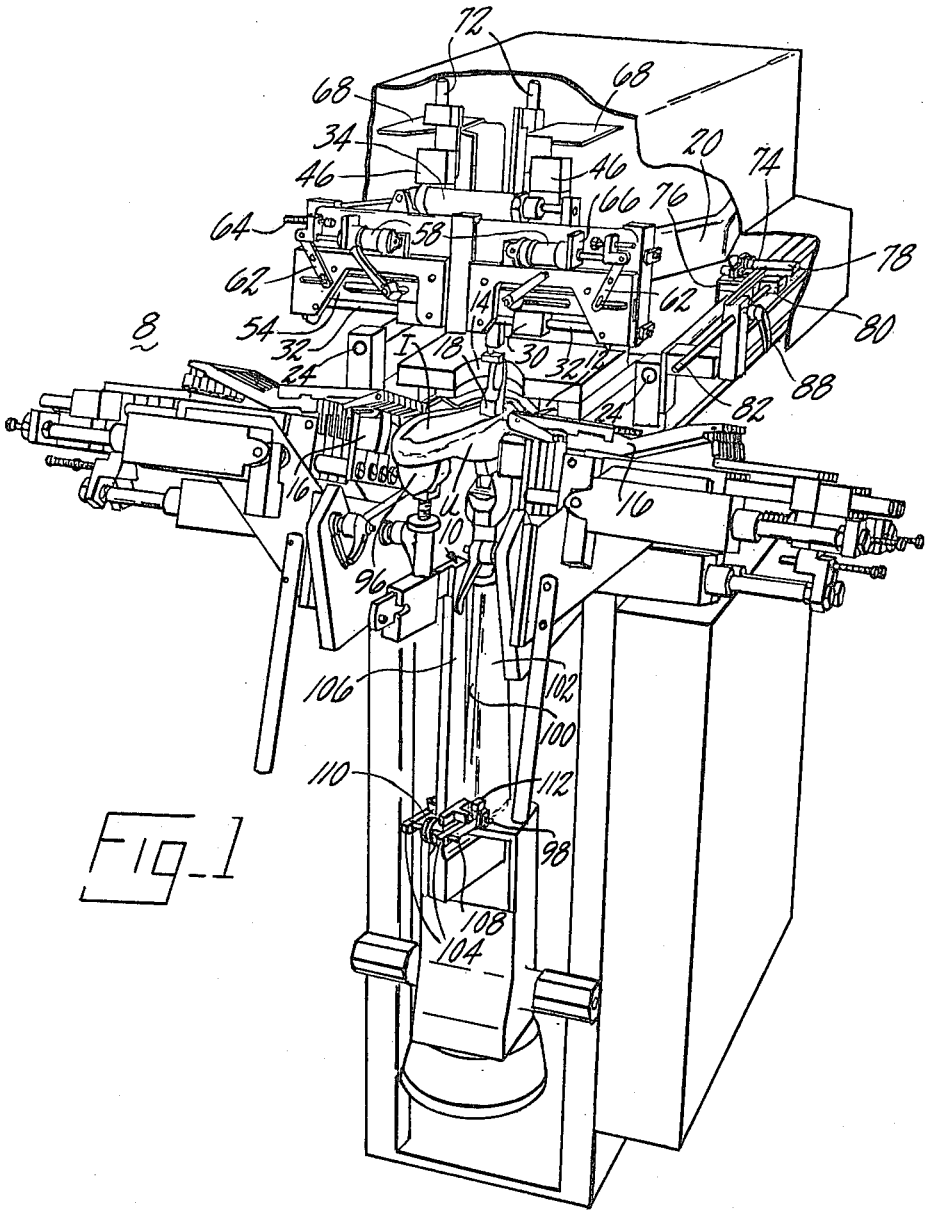
FIG. 1 is a front perspective view of a shoe lasting machine manufactured in accordance with the invention.

Referring now to the drawings in detail, and particularly to FIG. 1, there is shown a combined heel seat and side lasting machine 8 comprising a last support 10 on which a last can be supported, bottom uppermost, with an insole I located on the bottom thereof and a shoe upper U positioned thereon. The machine further comprises heel seat wiping instrumentalities, including an arrangement of heel seat wipers 12 and a heel band 14, and also a pair of side lasting assemblies 16, arranged forwardly of the heel seat wipers 12, one at either side of the last support 10. The side lasting assemblies 16 may be as described in the specification of our U.S. Pat. No. 4,296,513. The machine 8 also comprises a holddown 18. The heel seat wipers 12 and the holddown 18 are of generally conventional construction and operation.

Figure 2:
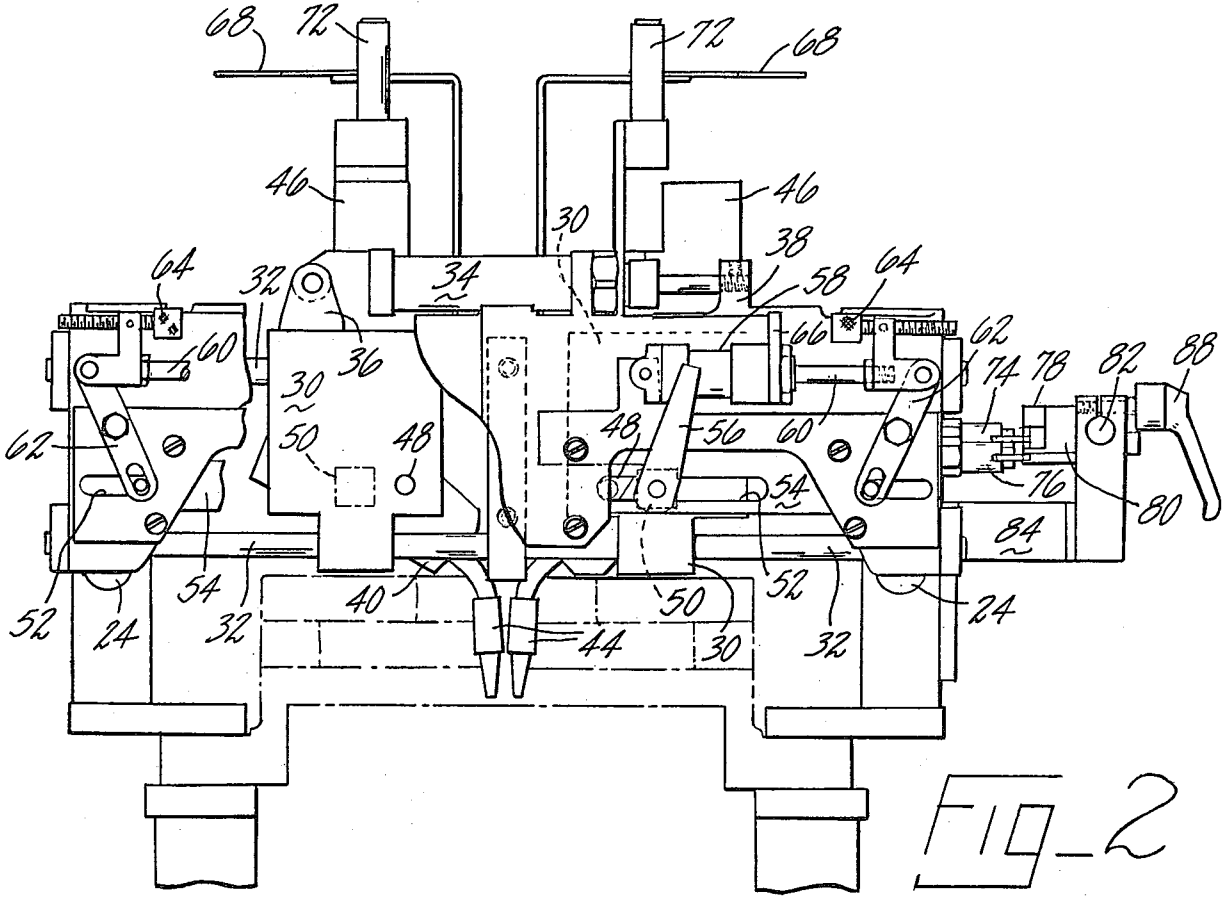
FIG. 2 is a fragmentary front view showing a cement applying means, including a pair of nozzles and a nozzle guidance mechanism, of the machine shown in FIG. 1.
Figure 3:
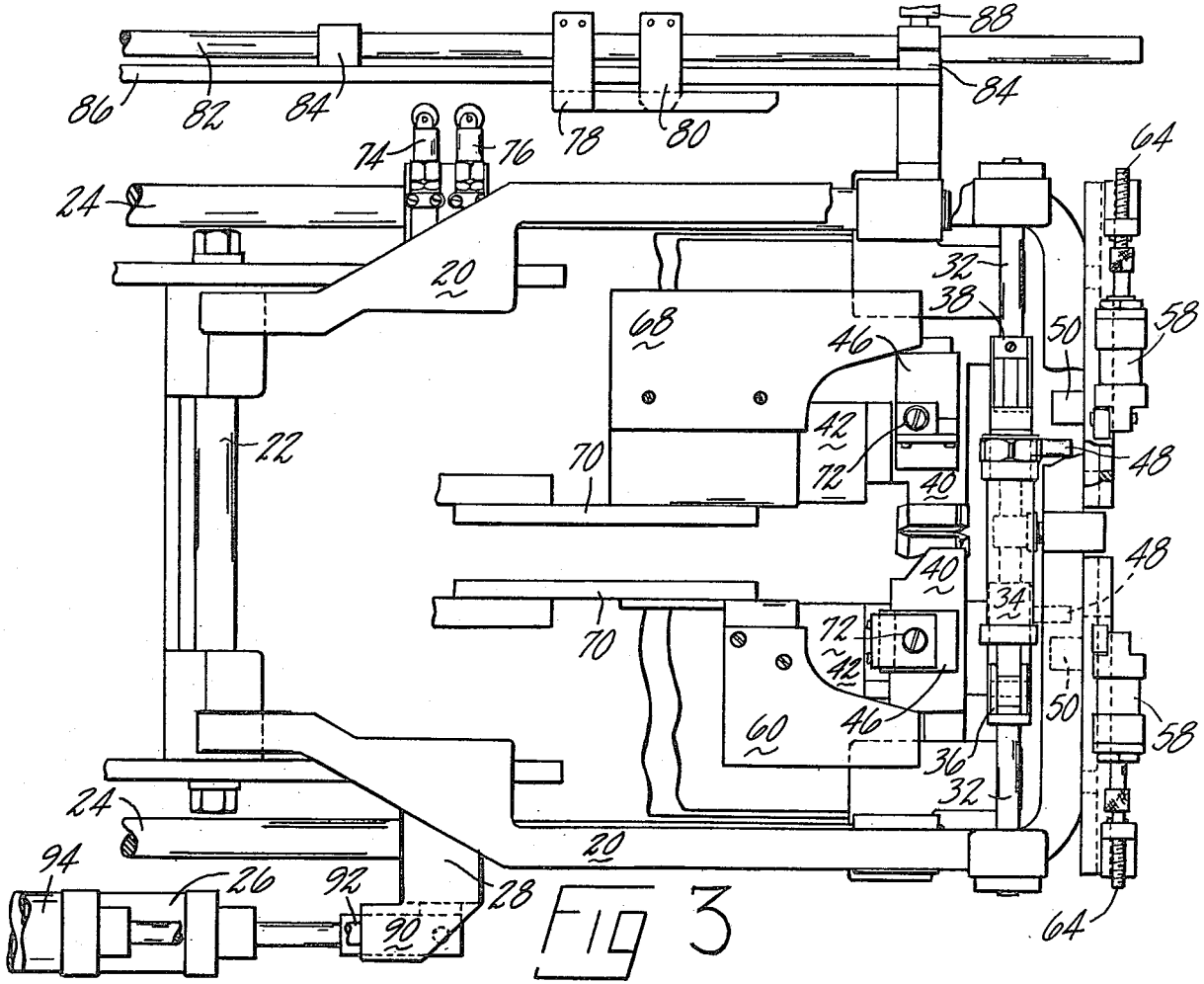
FIG. 3 is a fragmentary plan view of parts of the machine shown in FIG. 2.

The machine 8 further comprises cement applying means (as shown in FIGS. 2 and 3), comprising a main carrier 20 mounted for pivotal movement about an axis 22 extending widthwise of the machine, and also for movement fore-and-aft of the machine along an arrangement of slides 24 fixed on the machine frame. A piston-and-cylinder arrangement, not shown, is provided to effect pivotal movement of the carrier 20, and a piston-and-cylinder arrangement 26 acting on a lug 28 of the carrier is provided to effect fore-and-aft movement thereof.

A pair of support blocks 30 are supportably mounted in the carrier 20 for sliding movement, widthwise of the carrier, each on a rod 32 in the carrier 20. The support blocks 30 are caused to move, in contrary directions, by a single piston-and-cylinder arrangement 34 connected between an arrangement of upstanding lugs 36 and 28, on the support blocks 30. Each support block 30 carries a valve body 40 and a melt body 42 to which adhesive can be fed, e.g. in rod form, the valve body 40 incorporating a needle valve, not shown, for controlling the flow of adhesive from the melt body through an arrangement of nozzles 44 by which adhesive can be applied between marginal portions of the insole I and shoe upper U in the region thereof to be lasted. The valves 40 are each opened and closed by a piston-and-cylinder arrangement 46.

Each support block 30, and thus each of the nozzles 44, has a forwardly projecting pin 48 arranged to engage an abutment 50 to control widthwise movement thereof. Each abutment 50 is adjustably positioned in a slot 52 formed in a slide 54 which is mounted for sliding movement in the main carrier 20. The abutment 50 is clamped in position in the slot 52 by a clamping handle 56.

Each slide 54 has a piston-and-cylinder arrangement 58 fixed on the main carrier 20 with a piston rod 60 connected through a link 62 to the slide 54, each link 62 being mounted for pivotal movement on the main carrier 20.

When the piston rods 60 are in an extended condition, the abutments 50 associated therewith are in a first position, which is set by the operator according to the width of the shoe bottom in the waist region thereof, the abutments 50, in cooperation with the pins 48, serving to guide the nozzles 44 in a straight line path. Upon actuation of either one of the piston-and-cylinder arrangements 58, on the other hand, the slide 54 associated therewith, and thus the associated abutment 50, is moved to a second position to a limit determined by a stop 64 carried by the piston rod 60 and is engageable with an abutment face 66 provided on the body of the piston-and-cylinder arrangement 58. The stop 64 is set according to the width of the shoe bottom in the ball region thereof.

In order to hold each abutment 50 in its first position, the pressure of air applied to the piston-and-cylinder arrangement 58 associated therewith must be sufficient to withstand the pressure applied to the piston-and-cylinder arrangement 34 and to the pins 48. Furthermore, when the piston-and-cylinder arrangement 58 is actuated as aforesaid, the speed of outward movement of the abutment 50, and thus of the nozzle 44 associated therewith, can be regulated so as to accommodate the angular divergence of the cementing path of that nozzle from the straight line path it follows under the control of the abutment 50 in its first position. This accommodation is of course also determined by the speed of advance of the main carrier 20 under the action of the piston-and-cylinder arrangement 26.

The machine 8 also comprises a pair of templates 68, shown in FIG. 3, which are each fixedly mounted on an upstanding frame member 70, an which cooperate with an arrangement of upstanding pins 72 mounted on top of the piston-and-cylinder arrangements 46 controlling the cement flow valves of the cement applying means. In operation, the templates 68 act to control outward movement of the nozzles 44, under the action of the piston-and-cylinder arrangement 34, from an initial position, in which they are adjacent one another, into the first position previously referred to, controlled by the abutments 50.

When the machine 8 is in a rest condition, the main carrier 20 is in a raised condition in which the nozzles 44 are lifted away from the last support 10, in order to enable a last with a shoe upper U and insole I thereon to be loaded on to the last post and be swung into the heel band 14. Upon initiation of a cycle of operation of the machine, the holddown 18 is first lowered into engagement with the insole I, to establish the operating height of the shoe bottom, and thereafter the main carrier 20 is lowered to bring the nozzles 44 into engagement with the insole I, and at the same time the main carrier 20 is moved rearwardly, under the action of the piston-and-cylinder arrangement 26, to a limit determined by a valve, not shown. Actuation of this valve is then effective to cause the piston-and-cylinder arrangements 46 to operate to switch on the cement flow from the nozzles 44 and at the same time to initiate forward movement on the main carrier 20, together with the nozzles 44. Initially, the nozzles are in their start-up position, that is adjacent one another, and are arranged in the region of the back seam portion of the shoe upper U, and, upon initiation of forward movement of the carrier, are urged outwardly under the action of the piston-and-cylinder 34, such outward movement being controlled by the templates 68 cooperating with the upstanding pins 72. When the pins 48 engage the abutments 50, the nozzles are removed from the control of the templates 68 and continue, during continued forward movement of the main carrier 20, in a straight line path along the waist region of the shoe bottom. Movement from the initial position to the first position of the nozzles as aforesaid is effective to cause a generally V-shaped cement application pattern to be formed in the heel seat region of the shoe bottom.

The extent of forward movement of the main carrier is controlled by a valve 74 mounted on the carrier for movement therewith. Similarly, a valve 76 is mounted on the carrier for controlling the operation of the piston-and-cylinder arrangements 46. The valves 74 and 76 are each actuated by a cam 78 and 80, which are mounted on a support bar 82 itself supported for sliding movement on arrangement lugs 84 of the main frame of the machine. A strengthening bar 86 extends between the lugs 84. The cams 78 and 80, are fixed on the support bar 82 and the position relative to the valves 74 and 76, can thus be adjusted by sliding the support bar 82. A clamping handle 88 is provided for clamping the support bar 82, and thus the cams 78 and 80, in adjusted position. In addition, for major adjustments, each cam 78 and 80 can be independently adjusted on the support bar 82.

The valve 76 is effective to arrest the forward movement of the main carrier 20 and also to cause it, to be raised, together with the nozzles 44, out of engagement with the shoe bottom. Furthermore, the valve 76 is effective, when the main carrier 20 has been raised, to return the carrier rearwardly to its rest condition. The rest condition is determined by an abutment 90 on the lug 28 on the carrier 20 engaging a piston rod 92 of a piston-and-cylinder arrangement 94 mounted on the frame above the piston-and-cylinder arrangement 26, the piston rod 92 being held in an extended condition at this time by admission of fluid under pressure to the cylinder. By permitting the carrier to come to rest in an intermediate position in this manner, it is ensured that, in the next cycle of operation, the nozzles 44 can be brought into engagement with the insole I well clear of the upstanding lasting margin at the back seam region of the shoe.

The valve 74 is effective, when actuated, to operate the piston-and-cylinder arrangements 46 whereby the flow of adhesive through the nozzles 44 is cut off. Actuation of the valve 74 is timed to take place because there is a delay between actuation and the discontinuation of adhesive from the nozzles 44, due to the time delay in the pneumatic circuitry and also because of the drooling of the adhesive after the valve 74 has moved to cut-off position.

Actuation of the valve 74 is also effective to operate one of the piston-and-cylinder arrangements 58 to cause its associated abutment 50 to be moved from its first to its second position, and thus to allow the pin 48, and its associated nozzle 44, to move outwardly, as above described.

For determining which abutment is to be so moved, the machine 8 comprises a selector means which is operated by movement of the last support 10 to determine which abutment is to be moved. A toe rest 96 of the last support 10 can pivot between two positions according to whether the shoe to be lasted is a left or a right, so that the selector means, being operated according to whether the toe rest 96 is in one or other of its two positions, is also operated according to whether the shoe to be lasted is a left or a right. The two positions of the toe rest 96 are determined by a pair of stops 98 arranged to engage one at either side of a rib 100 formed on a support 102 for a heel pin, not shown, of the last support 10. The two positions are varied according to the angle between a center line of the forepart portion and a center line of the heel seat portion of a shoe to be lasted, the stops 98 being movable symmetrically toward and away from said rib. Each stop 98 is carried at one end of a link 104 pivotally mounted on a toe rest support 106. The toe rest support 106 is mounted for pivotal movement to move the toe rest between its two positions. The forward ends of the links 104 are connected by a threaded rod 108 provided with a centrally disposed knurled roll 110 and threads of opposite hand, so that rotation of the rod 108 by the roll 110 is effective to move the forward ends of the links toward and away from one another.

The selector means comprises a pair of valves 112 mounted on the ends of the links 104, one above each of the stops 98, and each having a plunger engageable with the rib 100. Thus, pivotable movement of the toe rest support 106 into one of its positions is effective to cause one or the valves 112 to be actuated, and pivotal movement into the other of said positions causing the other of said valves to be actuated. Actuation of each valve causes its associated piston-and-cylinder arrangement 58 to be actuated, upon actuation of the valve 74.

The position of the valve 74 in relation to the valve 76 is such that, under the action of piston-and-cylinder arrangement 58, the appropriate abutment 50 is moved outwardly to its second position determined by the associated stop 64 before the forward movement of the main carrier 20 is arrested by actuation of the valve 76, and the nozzles 44 are raised from contact with the shoe bottom.

Thus there has been described a combined heel seat and side lasting machine having means for adjusting and compensating said machine to facilitate applying cement and lasting either a right or left shoe.

Having thus described our invention, what we claim as new and desire to secure by Letters Patent of the United States is:

1. A shoe upper machine for use in the lasting of side portions of shoe uppers comprising:

a support for a shoe last on which an upper, the side portions of which are to be lasted, and an insole are positioned, has thereadjacent a pair of side lasting assemblies arranged so as to act on opposite side portions of an upper placed on a last support by said support;

cement applying means and means for effecting relative movement between said means and the last support in a direction extending lengthwise of the bottom of a shoe supported on said support, whereby cement can be progressively applied, prior to the operation of said side lasting assemblies, between marginal portions of the insole and shoe upper in the region thereof to be lasted;

said cement applying means comprising a pair of nozzles which are arranged to apply the cement along opposite marginal portions simultaneously and at least one of said nozzles is movable transversely of the shoe bottom under the control of a guide mechanism associated therewith from a first to a second predetermined position during the relative movement between the cement applying means and the last support as aforesaid;

actuating means being provided for actuating said guide mechanism to enable such transverse movement to take place at a selected stage in said relative movement, said nozzle guidance mechanism associated with said one nozzle comprises an abutment engageable by a portion of said nozzle.

2. A shoe upper machine as recited in claim 1 wherein the other of said nozzles is maintained in a fixed position transversely of the shoe bottom during relative movement between said cement applying means and said last support.

3. A shoe upper machine as recited in either one of claims 1 and 2 wherein said abutment has a first and a second position, corresponding to the first and second predetermined positions of the nozzle; and means for moving the abutment between said positions thus to allow movement of the nozzle between its predetermined positions as aforesaid.

4. A shoe upper machine as recited in claim 3 wherein said abutment is mounted in a support which is movable by said abutment moving means, a second abutment being provided for limiting such movement of the support, and thus for determining the second position of the first-mentioned abutment.

5. A shoe upper machine as recited in claim 4 wherein the first-mentioned abutment is adjustably mounted in the support, thus to vary the first position thereof.

6. A shoe upper machine as recited in claim 4 or claim 5 wherein the second abutment is adjustable, to vary the second position of the first-mentioned abutment.

7. A shoe upper machine as recited in claim 4, claim 5 or claim 6 wherein the abutment moving means comprises a piston-and-cylinder arrangement.

8. A shoe upper machine as recited in claim 7 wherein means is provided for moving said nozzle to bring said portion thereof into engagement with said first-mentioned abutment, said nozzle moving means comprising a piston-and-cylinder arrangement, said arrangement being such that the fluid pressure applied to the piston-and-cylinder arrangements is such that the piston-and-cylinder arrangement of the abutment moving means can hold the abutment in its first position when the stop is urged thereagainst by the piston-and-cylinder arrangement of the nozzle moving means.

9. A shoe upper machine as recited in claim 8 wherein said piston-and-cylinder arrangement of the abutment moving means is double-acting, application of fluid pressure to one side thereof being effective to hold the abutment in its first position as aforesaid, and application to the other side thereof causing the abutment to be moved to its second position.

10. A shoe upper machine as recited in claim 9 wherein means is provided for variably regulating the pressure of the fluid supplied to the piston-and-cylinder arrangement of the abutment moving means.

11. A shoe upper machine as recited in claim 10 wherein each nozzle is movable transversely of the shoe bottom under the control of an associated guide mechanism from a first to a second predetermined position, during relative movement between the cement applying means and the last support as aforesaid, the arrangement being such that, in a cycle of operation of the machine, only one of the nozzles is so moved, selector means being provided for determining which of the two guides mechanisms is actuated in said cycle to enable transverse movement of its associated nozzzle to the take place at said selected stage in said relative movement.

12. A shoe upper machine as recited in claim 11 wherein the nozzle moving means comprises a single double-ended piston-and-cylinder arrangement.

13. A shoe upper machine as recited in claim 12 wherein the actuating means is adjustable by the operator according to the side of shoe being operated upon.

14. A shoe upper machine as recited in claim 13 wherein each nozzle is movable between an initial position, in which the two nozzles are adjacent one another, and a position determined by its associated guide mechanism.

15. A shoe upper machine for use in the lasting of heel seat and side portions of a shoe upper, comprising:

a support for a shoe last on which an upper, the side portions of which are to be lasted, and an insole are positioned, a heel band, heel seat wiper means and two side lasting assemblies arranged to act respectively on the heel seat and opposite side portions of an upper placed on a last supported by the last support;

cement applying means movable lengthwise of the bottom of a shoe supported on the last support from a start position at the heel end of said shoe toewardly, whereby cement can be progressively applied, prior to the wiping operation, between marginal portions of the insole and shoe upper in the region thereof to be lasted;

said cement applying means comprises a pair of nozzles arranged to apply cement along opposite marginal portions simultaneously; and a pair of nozzle guide mechanisms, one associated with each nozzle, wherein each nozzle is movable transversely of the shoe bottom between an initial position, in which the two nozzles are adjacent one another, and a position determined by the guide mechanism associated with said nozzle, and further wherein one of the nozzles is movable transversely of the shoe bottom under the control of its associated guide mechanism from a first predetermined position, to which it is moved from said initial position as aforesaid, to a second predetermined position, the movement of said nozzle from its first to its second predetermined position taking place during relative movement between the cement applying means and the last support as aforesaid, actuating means being provided for actuating said guide mechanism to enable such transverse movement to take place at a selected stage in said relative movement.

16. A shoe upper machine as recited in claim 15 wherein said nozzle guide mechanisms comprise template means by which the nozzles are guided from their initial position as aforesaid.

* * * * *

UNITED STATES PATENT OFFICE

CERTIFICATE OF CORRECTION

Patent No. 4,338,695 Dated July 13, 1982

Inventor(s) W. H. Berrill and G. H. Bosworth

It is certified that error appears in the above-identified patent and that said Letters Patent are hereby corrected as shown below:

Claim 1 - Column 8, line 10 - Change "support" to "supported"

Claim 11 - Column 9, line 24 - Change "guides" to "guide"

Signed and Sealed this

*Twenty-sixth* Day of *October 1982*

[SEAL]

*Attest:*

GERALD J. MOSSINGHOFF

*Attesting Officer* *Commissioner of Patents and Trademarks*